US009260821B2

(12) United States Patent
Fink et al.

(10) Patent No.: US 9,260,821 B2
(45) Date of Patent: Feb. 16, 2016

(54) METHOD FOR CONVERTING A BALLASTED TRACK INTO A SLAB TRACK

(71) Applicants: Martin Fink, Bern (CH); Marco Habegger, Bern (CH); Peter Laborenz, Lüscherz (CH)

(72) Inventors: Martin Fink, Bern (CH); Marco Habegger, Bern (CH); Peter Laborenz, Lüscherz (CH)

(73) Assignee: SONNEVILLE AG (CH)

( * ) Notice: Subject to any disclaimer, the term of this patent is extended or adjusted under 35 U.S.C. 154(b) by 265 days.

(21) Appl. No.: 14/087,093

(22) Filed: Nov. 22, 2013

(65) Prior Publication Data

US 2014/0158785 A1 Jun. 12, 2014

(30) Foreign Application Priority Data

Dec. 7, 2012 (EP) ..... 12196118

(51) Int. Cl.

| | |
|---|---|
| ***E01B 29/00*** | (2006.01) |
| ***E01B 29/10*** | (2006.01) |
| ***E01B 1/00*** | (2006.01) |
| ***E01B 27/04*** | (2006.01) |
| ***E01B 29/06*** | (2006.01) |

(52) U.S. Cl.

CPC ..... *E01B 29/005* (2013.01); *E01B 1/001* (2013.01); *E01B 27/04* (2013.01); *E01B 29/00* (2013.01); *E01B 29/06* (2013.01); *E01B 29/10* (2013.01)

(58) Field of Classification Search

CPC ..... E01B 29/005; E01B 27/04; E01B 1/001; E01B 29/00; E01B 29/10

USPC ..... 238/2, 3, 5, 7, 8; 104/2, 7.3, 9

See application file for complete search history.

(56) References Cited

U.S. PATENT DOCUMENTS

| | | | | |
|---|---|---|---|---|
| 2,778,128 | A * | 1/1957 | Drouard | E01B 27/04 37/104 |
| 3,553,859 | A * | 1/1971 | McIlrath | E01B 27/04 104/12 |
| 5,653,388 | A * | 8/1997 | Pietschmann | E01B 1/004 238/7 |
| 6,237,856 | B1 * | 5/2001 | Bachmann | E01B 1/004 238/30 |
| 7,500,617 | B2 * | 3/2009 | Wirtz | E01B 1/004 238/2 |
| 7,850,089 | B2 * | 12/2010 | Freudenstein | E01B 1/004 238/2 |
| 7,975,932 | B2 * | 7/2011 | Graf Von Der Schulenburg-Wolfsburg | E01B 1/002 238/7 |
| 2007/0245921 | A1 * | 10/2007 | Haughey | E01B 29/10 104/2 |
| 2013/0277441 | A1 * | 10/2013 | Laborenz | E01B 1/004 238/3 |

FOREIGN PATENT DOCUMENTS

| | | |
|---|---|---|
| DE | 10 2004 019 083 A1 | 12/2004 |
| DE | 20 2009 008 365 U1 | 10/2010 |

(Continued)

*Primary Examiner* — Mark Le

(74) *Attorney, Agent, or Firm* — Ostrolenk Faber LLP

(57) ABSTRACT

In a section of a ballasted track that extends over a plurality of crossties, ballast is removed and crossties are removed. Crosstie blocks mounted in concrete slabs are inserted, lifted, and fastened to the rails. The rails are supported by temporary, vertically adjustable supports and adjusted. In an area that extends over a number of concrete slabs, infill concrete is filled in from the underground up to at least part of the height of the concrete slabs, and after the infill concrete has hardened, at least a part of each of the supports located between two respective concrete slabs is removed. The method allows the conversion to be carried out without changing the position of the rails. After the placement of the supports, the track is immediately operable again so that the relevant section need not remain closed until all method steps are completed.

15 Claims, 5 Drawing Sheets

(56) References Cited

FOREIGN PATENT DOCUMENTS

| | | | |
|---|---|---|---|
| EP | 0 894 897 | A1 | 2/1999 |
| EP | 0 894 898 | A1 | 2/1999 |
| EP | 1 048 783 | A1 | 11/2000 |
| WO | WO 00/61866 | | 10/2000 |

* cited by examiner

METHOD FOR CONVERTING A BALLASTED TRACK INTO A SLAB TRACK

FIELD OF THE INVENTION

The invention relates to a method for converting a ballasted track into a slab track.

BACKGROUND OF THE INVENTION

The increasing travelling speeds of trains call for slab tracks, which are capable of taking up the arising loads better than ballasted tracks. The reference WO00/61866 describes a method for renewing a railway track where the existing track bed that is associated with the track is removed and the track is laid on the substructure. After optionally building a substructure for the new railway track, at least one support layer for a slab track is built in and subsequently the existing track is dismantled. A slab track, more particularly with rails mounted on a concrete or asphalt support layer or rails having crossties that are cast into a concrete layer, is produced by building a new track and adjusting and fixing the new track.

The increasing traffic density on the railway networks calls for ever shorter interruptions for track maintenance and renewal. The aforementioned method is not suitable for a conversion of short track sections with short operation interruptions.

SUMMARY OF THE INVENTION

On this background, it is the object of the invention to suggest a method for converting a ballasted track into a slab track that is implementable on short track sections and therefore in relatively short periods such that the track is operable between these periods.

According to the invention, this object is achieved by a method for converting a ballasted track consisting of a ballast bed resting on a solid underground and of crossties lying thereon, to which rails are fastened by means of fixtures, into a slab track, wherein the method comprises the following method steps:

- ballast is removed in a section that extends over a plurality of said crossties,
- in said section a first number of said crossties are removed after releasing said rail fixtures,
- in said section, crosstie blocks are inserted, vertically positioned, and fastened to said rails,
- in said section, temporary, vertically adjustable supports are inserted on which said rails are resting and are supported on said underground,
- in an area that extends over a number of said crosstie blocks as seen in the direction of said rails, infill concrete is filled in from said underground up to at least part of the height of said crosstie blocks,
- after said infill concrete has at least partly hardened, at least a part of each of said supports located between respective two of said crosstie blocks in the direction of said rails is removed.

In particular, the solution according to the invention offers the advantage that the removal of ballast in a section that extends over a plurality of crossties makes room for producing a slab track without the need of changing the position of the rails. After the placement of the supports, the track is immediately operable again so that the relevant section need not remain closed until all method steps are completed. Since the supports are adjustable, no additional adjusting means are required for a precise vertical adjustment of the rails.

Particular embodiments of the method according to the invention are indicated in the dependent claims.

Another aspect of the invention relates to a crosstie unit for implementing the method according to the invention.

A further aspect of the invention relates to a support for implementing the method according to the invention.

BRIEF DESCRIPTION OF THE DRAWINGS

Exemplary embodiments of the method according to the invention and of the crosstie unit and the support will be described in more detail hereinafter by way of examples with reference to the appended drawings. The latter show FIG. 1 in a perspective view, the initial condition of a ballasted track laid in a concrete trough.

DETAILED DESCRIPTION OF THE INVENTION

Figure 1:
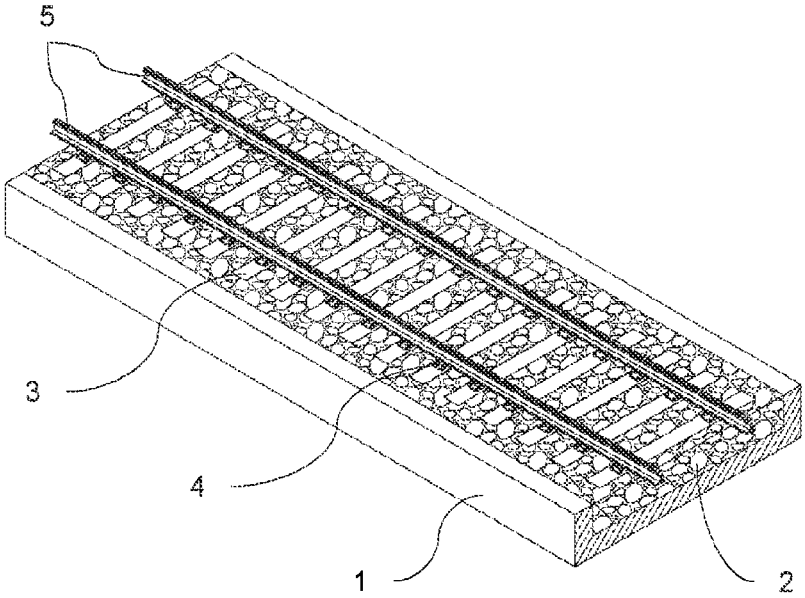

FIG. 1 shows the initial condition of the method, i.e. a ballasted track inside a concrete trough 1 that comprises crossties 3, e.g. wooden crossties, lying in a bed of ballast 2, and rails 5 fastened thereto by means of fixtures 4. The crosstie spacing is e.g. 60 centimeters.

Figure 2:
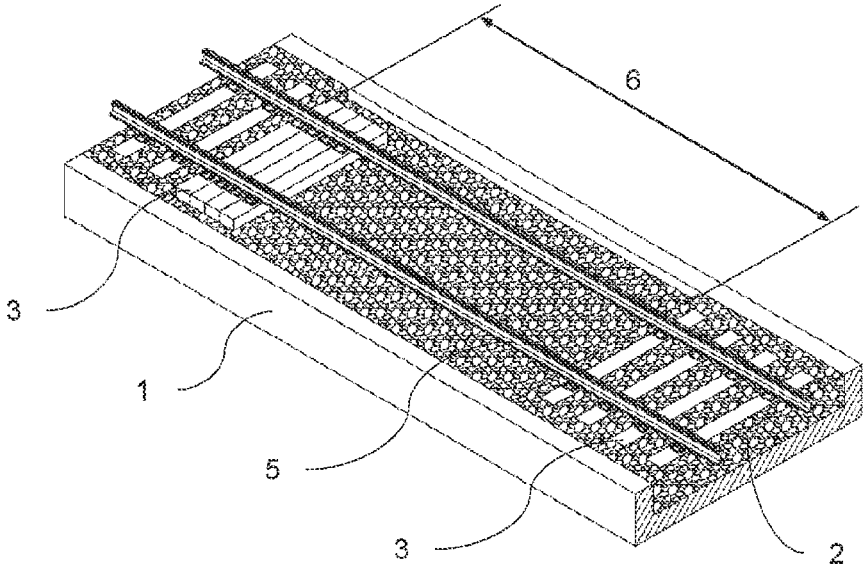
FIGS. 2 to 5 different method steps.

FIG. 2 illustrates a condition where in a track section 6 a part of ballast 2 has been removed so that in this track section 5 the lower surface of crossties 3 no longer lies on ballast 2 but crossties 3 are suspended to rails 5. The length of track section 6 is chosen such that substantially no sagging of the rails results in this section. In the depicted condition, of the ten crossties 3 originally located in track section 6, four were initially pushed together at one end of track section 6 after previously releasing fixtures 4 just enough to allow crossties 3 to be moved along rails 5 while being suspended thereto. By pushing them together in this manner, room is made for rotating the remaining six crossties 3 located in track section 6 by 90 degrees one after another and lifting them out between rails 5 without having to change the position of rails 5 for this purpose. Alternatively it would also be possible to dismantle the crossties that are to be removed and to remove them in pieces.

Figure 3:
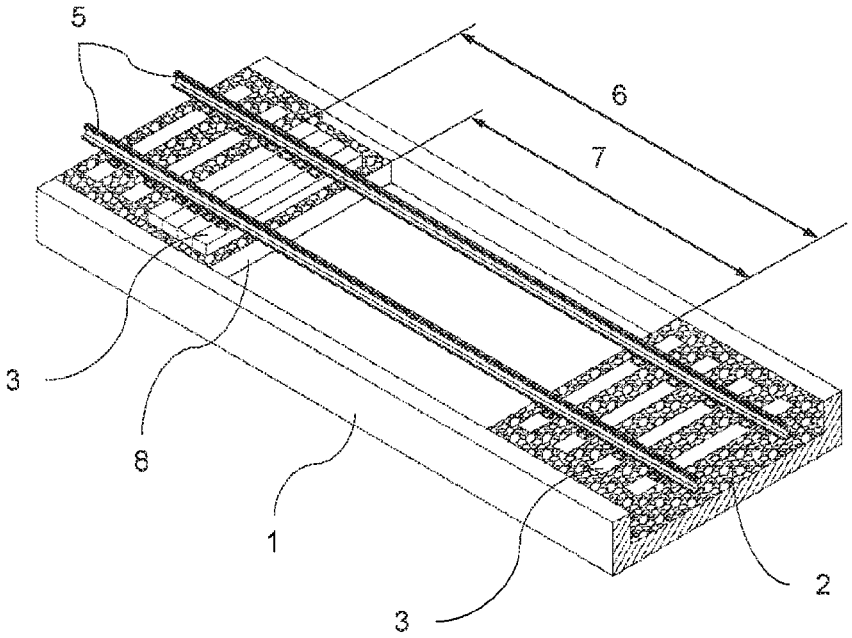

FIG. 3 shows a condition where inside track section 6 a working area 7 extending from the crossties 3 on the right side of the drawing that are still resting in ballast 2 to the crossties on the left of the drawing that have been pushed together has been completely emptied of ballast down to the bottom of concrete trough 1, and cleaned. The removal of the ballast can be achieved by mechanical or pneumatic means such as a suction device. Basically it is also possible to completely remove the ballast in a single operation, but the described stepwise procedure offers the advantage that the remaining ballast is much better accessible after pushing crossties 3 together resp. removing them. At both ends of working area 7, temporary boarding is inserted in order to retain the remaining ballast 2, only board 8 being visible in the figure.

Figure 4:
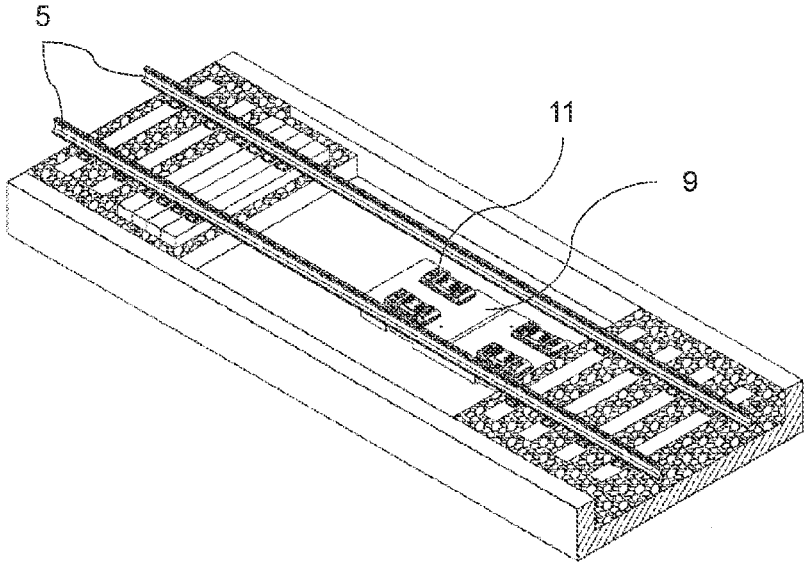
Figure 9:
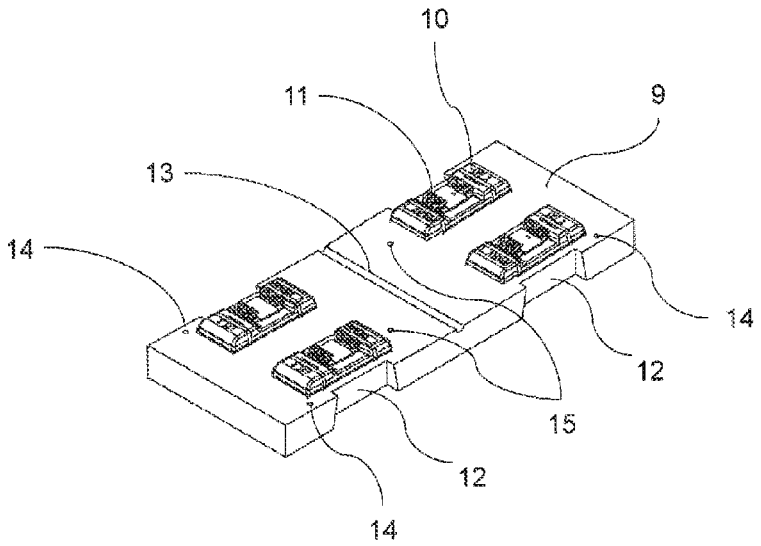
FIG. 9 a perspective view of a prefabricated crosstie unit.

FIG. 4 shows a situation where a prefabricated crosstie unit consisting of a concrete slab 9 provided in this example with four fixtures 11 for rails 5 mounted on concrete blocks 10 has been laid down on the underground between rails 5. However, the method according to the invention is not limited to the illustrated crosstie units but may alternatively be implemented with single block crossties or with crossties having two fixtures, one for each rail. Since the shorter side of concrete slab 9 fits between rails 5, concrete slab 9 can also be laid down without spreading rails 5 apart. At this point, reference is made to FIG. 9 which shows a crosstie unit consisting of a concrete slab 9 provided with four fixtures 11 for rails 5 mounted on concrete blocks 10 in perspective at an enlarged scale as compared to FIG. 4. Here, concrete blocks 10 are inserted in concrete slab 9 with intercalated rubber shoes that are not visible in the figure. The rubber shoes may e.g. be designed as shown in Patent CH695698, and a respective elastic inlay may be arranged between each rubber shoe and the bottom surface of concrete block 10. The long lateral edges of concrete slab 9 are provided with recesses 12 whose function will be described below in connection with FIG. 5. At the center of concrete slab 9, a drainage channel 13 to be arranged in parallel to the rails is visible. Four threaded sleeves 14 cast in in concrete slab 9 are intended for temporarily screwing in non-represented threaded spindles that are supported on the underground in order to thus lift and precisely position concrete slab 9 vertically and to maintain the latter in the vertical position until the infill concrete 24 to be described below has reached the desired early strength. Reference numeral 15 denotes lifting sleeves that may also be designed as threaded sleeves and serve for attaching lifting means such as eyebolts.

Figure 5:
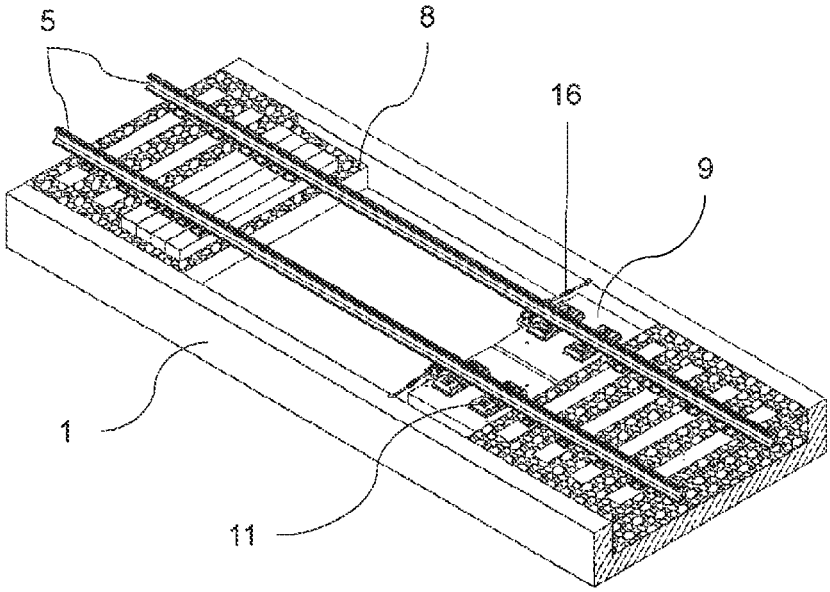
Figure 6:
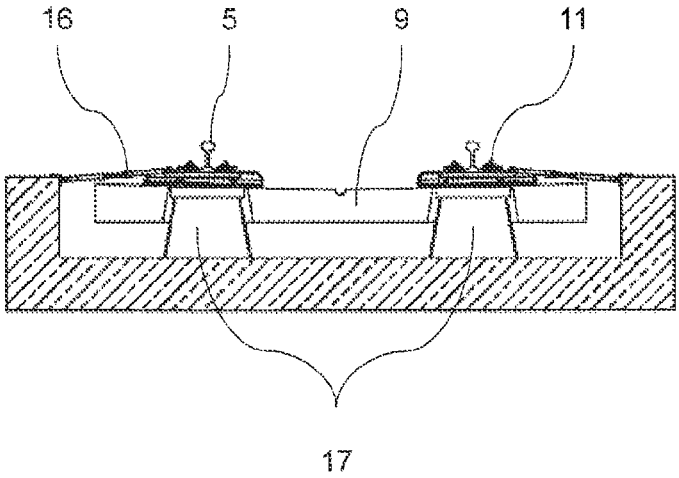
FIG. 6 a cross-section of the situation according to FIG. 5.
Figure 7:
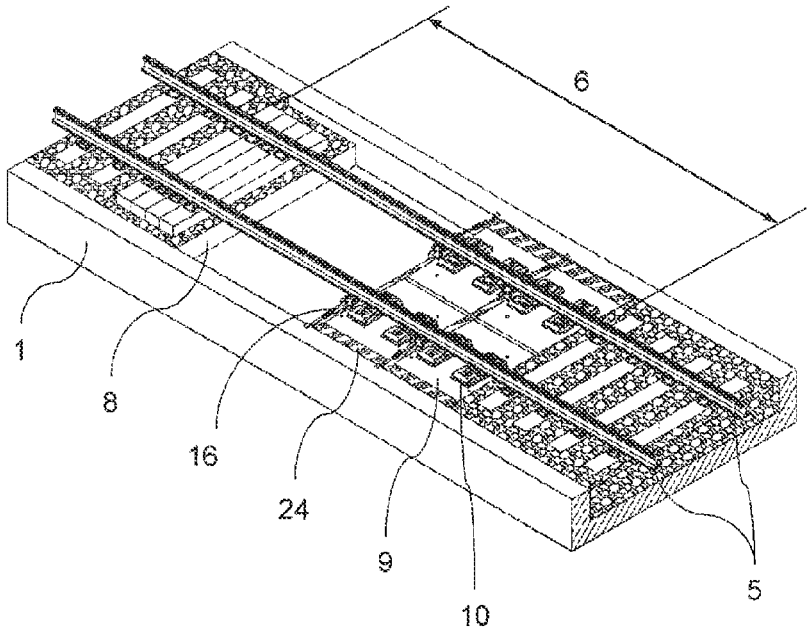
FIG. 7 a further method step.
Figure 10:
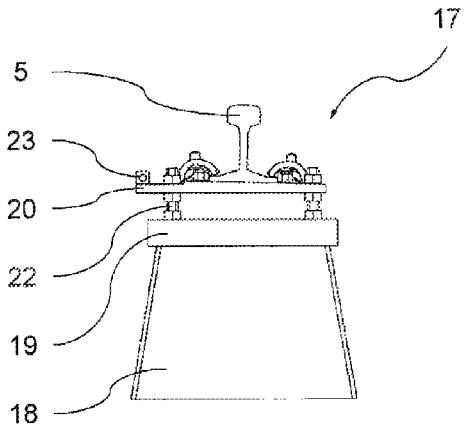
FIG. 10 an elevation of a support with a rail fastened thereto.
Figure 11:
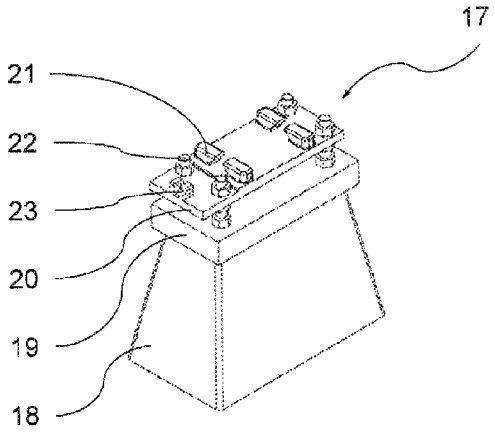
FIG. 11 the support of FIG. 10 in a perspective view without the rail and the rail fixture.

In the situation depicted in FIGS. 5 and 6, concrete slab 9 has been rotated 90 degrees relative to the position of FIG. 4, lifted, and fastened to rails 5 by means of fixtures 11. Consequently, concrete slab 9 is initially positioned at a distance above the underground on rails 5. Before another concrete slab 9 is inserted in the described manner, two supports 17 are placed on the underground so as to come to lie in recesses 12 of concrete slab 9 fastened to rails 5 without contacting concrete slab 9. Recesses 12 allow placing adjacent concrete slabs 9 very close to each other. FIGS. 10 and 11 show a support denoted by 17 as a whole. A conical concrete body 18 forms a base on which a first plate 19 is resting the underside of which has a recess to which the upper side of concrete body 18 is adapted so that plate 19 is precisely positioned on concrete body 18 and cannot slip laterally. A bearing plate 20 is supported on first plate 19 by spindles 22. By rotating spindles 22, the distance between plates 19 and 20 is adjustable. On upper bearing plate 20 lugs 21 are arranged which serve for receiving the heads of hook bolts by which provisional rail fixtures are fastened to rails 5. A fork 23 arranged on bearing plate 20 serves for fastening a lateral adjusting spindle 16 as illustrated in FIGS. 5 to 7. FIG. 6 shows the situation of FIG. 5 in a cross-sectional view. Supports 17 are shown which extend into the lateral recesses 12 of two concrete slabs 9 adjoining in the direction of the track. In this situation, if the track has to be temporarily operable for rail traffic, additional supports 17 may be built in in the free area between the concrete slab and boarding 8 to take up the loads.

FIG. 7 shows the situation after casting in two concrete slabs 9 by means of an infill concrete 24 that is as shrink-free as possible, e.g. from the company Concretum, or an equivalent product. Prior to concreting, form boards have been inserted on both sides of concrete slabs 9 as seen in the direction of the rails. Before infill concrete 24 has completely hardened, the threaded spindles maintaining concrete slab 9 in its vertical position are unscrewed from threaded sleeves 14. Subsequently or after the complete hardening of infill concrete 24, the units consisting of upper plates 20 and lower plates 19 are removed by first approaching upper plates 20 to lower plates 19 by rotating spindles 22 and then removing the units from concrete bodies 18, which remain in the track. As a result, the rails are supported on fixtures 11 and crosstie blocks 10 can freely move relative to concrete slab 9 under a passing train. Of course, adjusting spindles 16 are removed too.

Figure 8:
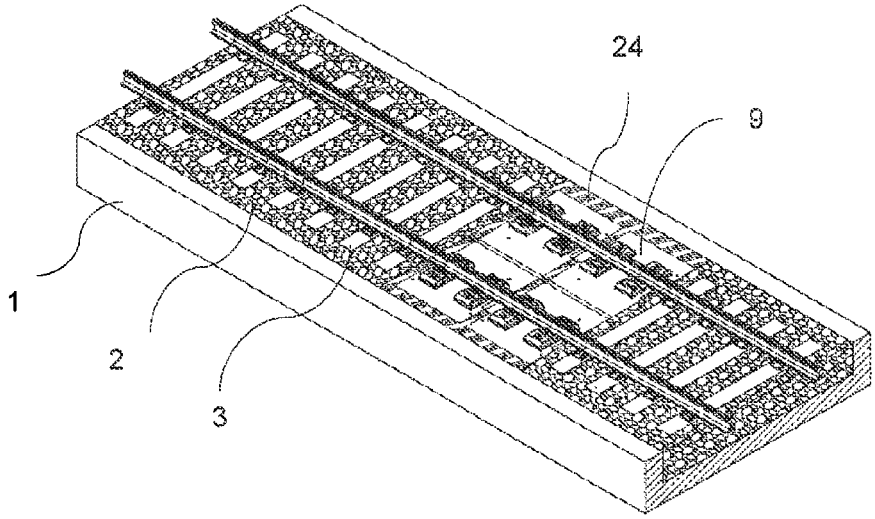
FIG. 8 the ballasted track with a section converted into a slab track.

In the situation illustrated in FIG. 8, the crossties 3 that were initially pushed together are again distributed according to the original crosstie spacing and ballast 2 is packed under them. This means that in this condition rails 5 are no longer supported by any temporary supports 17 of the kind shown in FIG. 10, which would be disadvantageous in that the track would not be able to yield under load and vibrations would be transmitted to the underground by supports 17. Consequently, in the condition illustrated in FIG. 8, the track section is operable without restrictions. The conversion of a different track section again starts with the method step described above with reference to FIG. 2. It is also possible to continue working on both sides of the already converted track section simultaneously.

In the foregoing, possible embodiments of the invention have been described whereas the invention is not limited to the depicted particular situations and views but various other combinations of features of the described and illustrated embodiments are possible.

LIST OF REFERENCE NUMERALS

1 concrete trough
2 ballast
3 crosstie
4 fixture
5 rail
6 track section
7 working section
8 boarding
9 concrete slab
10 crosstie block
11 fixture
12 recess
13 drainage channel
14 threaded sleeve
15 lifting sleeve
16 adjusting spindle
17 support
18 concrete body
19 plate
20 plate
21 lug
22 spindle
23 fork
24 infill concrete
25

The invention claimed is:

1. A method for converting a ballasted track that comprises a ballast bed resting on a solid underground, crossties lying on the ballast bed, and rails fastened on the crossties by rail fixtures, into a slab track, wherein the method comprises the following steps:

removing the ballast bed in a section of the track that extends over a plurality of the crossties, releasing said rail fixtures, removing a first number of said crossties after releasing the rail fixtures, inserting crosstie blocks in said section of the track in vertical positions, fastening the crosstie blocks to the rails, inserting temporary and vertically adjustable supports in said section of the track such that said adjustable supports are supported on said solid underground, resting said rails on said adjustable supports, filling concrete in an area that extends over a number of said crosstie blocks in a direction of said rails, from said solid underground up to at least part of a height of said crosstie blocks, removing a least a part of each of said adjustable supports located between said crosstie blocks in a direction of the rails; and wherein, said conversion is carried out without changing positions of the rails, and the track is immediately operable after placement of the supports without a need for closing the track until all method steps are completed.

2. The method of claim 1, wherein before removing said first number of said crossties, a second number of said crossties are pushed together at one end of said section after releasing the rail fixtures.

3. The method of claim 2, wherein said ballast is initially removed down to a level situated below a contact surface of said crossties; and after said second number of said crossties have been pushed together, the remainder of said ballast is removed down to said solid underground in an area that is free of said crossties.

4. The method of claim 2, wherein in order to be removed, said first number of crossties are rotated in the longitudinal direction of said crossties and lifted out between said rails.

5. The method of claim 3, wherein at least one end of said section of track that is free of said crossties, a temporary boarding for retaining said ballast remaining outside said section of track is arranged.

6. The method of claim 1, wherein at least two of said crosstie blocks are placed in a respective concrete slab and inserted together with said concrete slab.

7. The method of claim 6, wherein said concrete slabs are inserted by lowering them between said rails while oriented in the longitudinal direction of said rails and turning them around below said rails.

8. The method of claim 1, wherein before filling in said infill concrete, a space to be filled is separated by form boards.

9. The method of claim 1, wherein after said infill concrete has hardened, said crossties that were initially pushed together are again set apart and ballast is packed under them.

10. The method of claim 1, wherein a crosstie unit is provided and comprises a concrete slab and at least two of said crosstie blocks that are provided with fixtures for said rails.

11. The method of claim 10, wherein threaded sleeves for lifting spindles are embedded in said concrete slab.

12. The method of claim 10, wherein at least one lateral surface of said crosstie unit is provided with a recess in an area of one of said crosstie blocks.

13. The method of claim 10, wherein each of said crosstie blocks is received in said concrete slab with an intercalated elastic shoe that partly encloses said crosstie block.

14. The method of claim 1, wherein one of said supports comprising a supporting body and a bearing plate for one of said rails, wherein an adjuster device is provided for adjusting a distance between said supporting body and said bearing plate.

15. The method of claim 14, wherein on said bearing plate, fasteners for fastening said rails are arranged, and retainer devices for lateral fasteners are arranged.

* * * * *